US005166043A

United States Patent [19]

De Prijcker

[11] Patent Number: 5,166,043

[45] Date of Patent: Nov. 24, 1992

[54] LIGHT-SENSITIVE SILVER HALIDE MATERIAL FOR MAKING DIRECT-POSITIVE IMAGES

[75] Inventor: Jozef P. De Prijcker, Hamme, Belgium

[73] Assignee: Agfa-Gevaert, N.V., Mortsel, Belgium

[21] Appl. No.: 732,764

[22] Filed: Jul. 19, 1991

[30] Foreign Application Priority Data

Jul. 27, 1990 [EP] European Pat. Off. ..... 90202056.9

[51] Int. Cl.[5] ..... G03C 1/485; G03C 1/76

[52] U.S. Cl. ..... 430/539; 430/596; 430/598; 430/940; 430/961

[58] Field of Search ..... 430/598, 940, 961, 523, 430/596, 539

[56] References Cited

U.S. PATENT DOCUMENTS

| | | | |
|---|---|---|---|
| 3,761,266 | 9/1973 | Milton | 430/598 |
| 3,923,513 | 12/1975 | Evans | 430/598 |
| 4,302,526 | 11/1981 | Kohmura et al. | 430/523 |
| 4,777,113 | 10/1988 | Inoue et al. | 430/961 |

OTHER PUBLICATIONS

Research Disclosure, 23510, Nov. 1983 pp. 346–352.

*Primary Examiner*—Charles L. Bowers, Jr.
*Assistant Examiner*—Mark F. Huff
*Attorney, Agent, or Firm*—Breiner & Breiner

[57] ABSTRACT

Photographic light-sensitive silver halide material for forming direct-positive images comprising a support, a light-sensitive emulsion layer comprising unfogged internal latent image-type silver halide grains dispersed in a hydrophilic colloid binder and comprising a development nucleator, and at least one protective hydrophilic colloid layer, wherein said light-sensitive emulsion comprises at least one compound that during the development of said material in a surface developer provides iodide ions, the weight ratio of the hydrophilic colloid binder of said emulsion layer to silver halide expressed as silver nitrate ranging from 0.4:1 to 3:1, and said protective hydrophilic colloid layer having a thickness in dry state of 1 to 3 μm. The present invention also relates to a method for making direct-positive images with such a photographic light-sensitive silver halide material.

9 Claims, No Drawings

LIGHT-SENSITIVE SILVER HALIDE MATERIAL FOR MAKING DIRECT-POSITIVE IMAGES

BACKGROUND OF THE INVENTION

1. Field of the Invention

The present invention relates to a photographic light-sensitive silver halide material for forming direct-positive images, in particular computer output (COM) images, said material having a reduced tendency of getting sensitized under the influence of mechanical pressure exerted thereon in the period starting with its manufacture up to its development. The invention also relates to a method for making direct-positive images with such a photographic light-sensitive silver halide material.

2. Background of the Invention

In silver halide photography a photographic method, according to which a positive image is made without the use of a negative image or an intermediary process producing a negative image, is called a direct-positive method and a photographic light-sensitive material and a photographic emulsion for use according to such direct-positive method are called direct-positive material and direct-positive emulsion respectively.

Because of their practical and economical usefulness in the field of printing out of computer information preference is given nowadays to the use of direct-positive materials and direct-positive emulsions.

A variety of direct-positive photographic methods and materials are known. The most useful methods are the method, which comprises exposing a photographic material comprising prefogged silver halide grains to light in the presence of a desensitizing agent and developing them, and the method, which comprises subjecting a photographic material comprising silver halide grains that have light-sensitive specks mainly inside the grains to an image-wise exposure and developing the exposed material in the presence of a development nucleator or developing the exposed material after overall light-flashing it to fog. The present invention relates to the latter method and to photographic material comprising silver halide grains that have light-sensitive specks mainly inside the grains . Such a photographic silver halide emulsion material, which forms latent images mainly inside the grains, is referred to as internal latent image-type silver halide emulsion material, and thus is distinguished from silver halide grains that form latent images mainly at the surface of the grains.

It is known to develop a latent image that has been formed mainly inside the grains by means of a so-called internal developer, but the material and the emulsions used in accordance with the present invention are not concerned with that type of development, but rather with the type of development using a so-called surface developer.

It is also generally known that mechanical pressure applied to the photographic silver halide emulsion material in the period starting with its manufacture up to the development can produce both reversible and irreversible effects. Mechanical pressure can cause irreversible distortion of the emulsion grains or the formation of physical defects that alter the sensitivity for latent-image formation. Mechanical pressure can change the sensitivity of the emulsion coating, when it is applied before, during, or after the exposure thereof. A photographic direct-positive silver halide emulsion material comprising silver halide grains that have light-sensitive specks mainly inside the grains is particularly susceptible to sensitization under the influence of mechanical pressure in that at the places where pressure has been exerted unwanted white streaks or markings are left upon development.

SUMMARY OF THE INVENTION

It is therefore an object of the present invention to provide a photographic light-sensitive silver halide material for forming direct-positive images, in particular computer output (COM) images, said material having a reduced tendency of getting sensitized under the influence of mechanical pressure applied prior to the development.

Another object of the present invention is to provide a method for making developed direct-positive images that do not show unwanted white streaks or markings.

Other objects of the present invention will become apparent from the description hereinafter.

According to the present invention a photographic light-sensitive silver halide material for forming direct-positive images has been found, said material comprising a support, at least one light-sensitive emulsion layer comprising unfogged internal latent image-type silver halide grains dispersed in a hydrophilic colloid binder and comprising a development nucleator, and at least one protective hydrophilic colloid layer, characterized in that said light-sensitive emulsion comprises at least one compound that during the development of said material in a surface developer provides iodide ions, the weight ratio of the hydrophilic colloid binder of said emulsion layer to silver halide expressed as silver nitrate ranges from 0.4:1 to 3:1, and said protective hydrophilic colloid layer has a thickness in dry state of 1 to 3 μm.

The present invention also provides a method for making direct-positive images, said method comprising:

image-wise exposing a photographic light-sensitive silver halide material comprising a support, at least one light-sensitive emulsion layer comprising unfogged internal latent image-type silver halide grains dispersed in a hydrophilic colloid binder, and at least one protective hydrophilic colloid layer, and either (a) developing the image-wise exposed material in a surface developer in the presence of at least one development nucleator or (b) overall light-flashing to fog said image-wise exposed material and subsequently developing it in a surface developer, wherein (a) said light-sensitive silver halide material comprises at least one compound that during development of said material in said surface developer provides iodide ions, (b) the weight ratio of the hydrophilic colloid binder of said emulsion layer to silver halide expressed as silver nitrate ranges from 0.4:1 to 3:1, and (c) said protective hydrophilic colloid layer has a thickness in dry state of 1 to 3 μm.

DETAILED DESCRIPTION OF THE INVENTION

By image-wise exposing a photographic light-sensitive silver halide material as defined above and then either (a) developing it in said surface developer in the presence of at least one development nucleator contained in said light-sensitive emulsion layer or in a hydrophilic colloid layer in water-permeable relationship therewith or in said surface developer, or (b) overall light-flashing to fog said image-wise exposed material and subsequently developing it in said surface developer, it has been found unexpectedly that the direct-positive images obtained do not show unwanted white streaks or markings.

For easiness' sake the at least one compound that during development of said light-sensitive material in a surface developer provides iodide ions, which are in excess of any such ions provided by the light-sensitive emulsion itself, is called iodide ion-providing compound hereinafter.

Although the use of iodide ion-providing compounds in internal latent image-type silver halide emulsion material is known per se from GB-A 1,151,363, 1,195,837, and 1,187,029, the use of such compounds in combination with the use of a weight ratio of the hydrophilic colloid binder in the emulsion layer to silver halide expressed as silver nitrate of 0.4:1 to 3:1 as well as with the use of a protective hydrophilic colloid layer having a thickness in dry state of 1 to 3 μm was found to be unknown for direct-positive materials. This threefold combination of measures has brought the unexpected advantages found in the direct-positive materials of the present invention.

The iodide ion-providing compound may be present in the light-sensitive silver halide emulsion itself or, alternatively, in another layer that stands in water-permeable relationship with said light-sensitive silver halide emulsion so that the iodide ions can act upon said light-sensitive silver halide emulsion during said development.

The iodide ion-providing compound can be incorporated into the light-sensitive material by soaking the latter in an aqueous composition comprising said compound or it can be incorporated into a composition used to form a coating layer of the light-sensitive material.

The iodide ion-providing compound is preferably present in the at least one light-sensitive silver halide emulsion layer and preferably it is added to the coating composition that will form such layer.

The iodide ion-providing compound is present in the light-sensitive material in a concentration ranging from 0.005 to 20 g per mol of silver halide, preferably 0.01 to 1 g.

Suitable iodide ion-providing compounds include water-soluble iodides, inorganic and organic iodides, organic compounds with labile iodine atom, and onium chloroiodates.

Suitable inorganic iodides are e.g. calcium iodide, ammonium iodide, lithium iodide, magnesium iodide, potassium iodide, sodium iodide, barium iodide, cadmium iodide, and zinc iodide.

Suitable organic iodides are e.g. tetramethylammonium iodide, tetraethylammonium iodide, 1,1,1,-dodecyldimethylhydrazinium iodide, 1-methyl-8-hydroxyquinolinium iodide, 1-methyl-2-iodoquinolinium iodide, 1,2,3,4-tetrahydro-8-hydroxy-1,1-dimethyl-quinolinium iodide, benzyltriphenylphophonium iodide, S,S'-bis-dimethyl- hexamethylene-1,6-disulphonium iodide, 3,5-dimorpholinodithiolium iodide, and diphenyl-iodonium iodide.

Organic iodides with labile iodine atom, which have proved to be suited for use according to the present invention are e.g. mono-iodo-acetic acid and the potassium salt of 4-iodo-butane sulphonic acid.

Suitable onium chloroiodates for use according to the present invention are e.g. those described in BE-A 515,895. Specific examples of such compounds are e.g. trimethyl-o-(methoxycarbonyl)-anilinium dichloroiodate and benzyltriphenylphosphonium dichloroiodate.

A preferred iodide ion-providing compound is molecular iodine. Other preferred compounds are the addition products of iodine with polyvinyl pyrrolidone, with polyalkenes and derivatives thereof, or with quaternary ammonium compounds.

The weight ratio of the hydrophilic colloid binder of said emulsion layer to silver halide expressed as silver nitrate ranges from 0.4:1 to 3:1. Preferably, the weight ratio of the hydrophilic colloid binder of said emulsion layer to silver halide expressed as silver nitrate preferably ranges from 0.5:1 to 2:1.

The photographic light-sensitive direct-positive silver halide material of the present invention comprises an internal latent image-type silver halide emulsion layer, which preferably is a gelatin silver halide emulsion layer. However, instead of gelatin or in admixture with gelatin a variety of other hydrophilic colloids can be used as the binder for the silver halide.

Other suitable hydrophilic colloids that can be used as the binder for the silver halide are synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Other synthetic substitutes for gelatin are latices such as a latex of poly(ethyl acrylate). Natural substitutes for gelatin are e.g. other proteins such as zein, albumin and casein, cellulose derivatives, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates. The presence of such other binders often has a favourable photographic effect on the formation of the direct-positive image. For instance, the addition of polyvinyl pyrrolidone and of said latex of poly(ethyl acrylate) often increases the maximum density of the direct-positive image.

The hydrophilic colloid binder should dispose of an acceptably high number of functional groups, which by reaction with an appropriate hardening agent can provide a sufficiently resistant layer. Such functional groups are especially the amino groups, but also carboxylic groups, hydroxy groups, and active methylene groups.

The gelatin can be lime-treated or acid-treated gelatin. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966).

The protective hydrophilic colloid layer coated on top of the emulsion layer has a thickness in dry state of 1 to 3 μm. The hydrophilic colloid can be a protein e.g. gelatin, a cellulose derivative such as an alkyl cellulose e.g. hydroxyethyl cellulose or carboxymethyl cellulose, alginic acid or a derivative thereof, gum arabic, polyvinyl alcohol, polyvinyl pyrrolidone, or mixtures of these. Preferably, the hydrophilic colloid of the protective layer is gelatin.

For carrying out the method of the present invention the at least one development nucleator may be incorporated in the developer or in a prebath applied to the exposed photographic material before development thereof. Preferably, however, the at least one development nucleator is incorporated into the silver halide emulsion layer or into a hydrophilic colloid layer in water-permeable relationship therewith.

The development nucleators may be any of the compounds known for that purpose. Suitable development nucleators are e.g.: sulphur compounds e.g. thiourea dioxide, phosphonium salts e.g. tetra(hydroxymethyl)-phosphonium chloride, hydroxylamine, bis-(p-aminoethyl)sulphide and water-soluble salts thereof, reductic acid and derivatives thereof e.g. 4,4,5,5-tetramethylreductic acid, kojic acid, ascorbic acid, 2-hydroxy-1,3-cyclohexanedione, 2-acetoxy-1,2- di(2-pyridyl)-ethanone, 2-hydroxy-1,2-di(2-pyridyl)-ethanone, reactive N-substituted cycloammonium quaternary salts, and hydrazine-type compounds e.g. 1-diphenyl-hydrazine hydrochloride and 1,2-dipyridyl-hydrazine hydrochloride.

Suitable development nucleators of the class of reactive N-substituted cycloammonium quaternary salts correspond to the following general formula I:

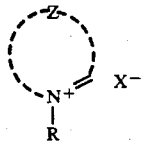

(I)

wherein:

R represents hydrogen, an alkyl group, a substituted alkyl group, an aralkyl group, a substituted aralkyl group, an alkaryl group, a substituted alkaryl group, an aryl group, or a substituted aryl group, Z represents the atoms needed to complete a heterocyclic nucleus or a substituted heterocyclic nucleus, which heterocyclic nucleus may carry a fused-on heterocyclic or carbocyclic ring, and X is an anion.

A representative development nucleator corresponding to general formula I has the following structural formula :

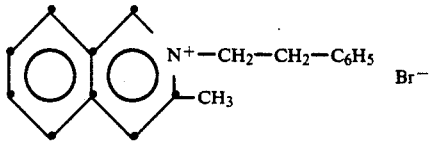

Other suitable development nucleators are the hydrazine-type compounds corresponding to the following general formula II:

$$R^1—NH—NH—CO—R^2 \quad (II)$$

wherein:

each of $R^1$ and $R^2$ (same or different) represent hydrogen, an alkyl group, a substituted alkyl group, an aryl group, or a substituted aryl group.

Preferred development nucleators are phenyl hydrazides e.g. 1-formyl-2-phenyl-hydrazine, 1-p-acetamidophenyl-2-acetyl-hydrazine, and 1-[2-(2,4-di-tert-pentyl-phenoxy)-propionamidophenyl]-2-formyl-hydrazine.

Another class of suitable hydrazine-type development nucleators are hydrazines comprising a heterocyclic nitrogen-containing nucleus or a substituted heterocyclic nitrogen-containing nucleus e.g. a thiohydantoin nucleus and a mercaptotetrazolyl nucleus. Examples of such compounds are the following compounds III and IV:

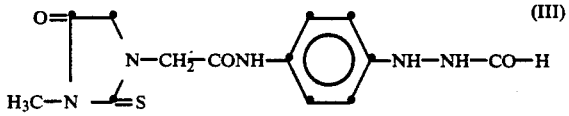

(III)

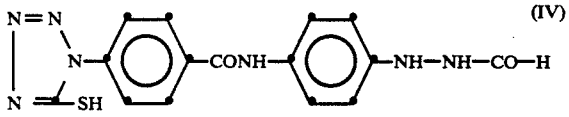

(IV)

A preferred class of hydrazine-type development nucleators comprising a heterocyclic nitrogen-containing nucleus are the hydrazines carrying a pyrazolidin-3-one-1-yl-phenyl group or a substituted pyrazolidin-3-one-1-yl-phenyl group. Examples of such preferred development nucleators are the compounds according to the following structural formulae V to XIII:

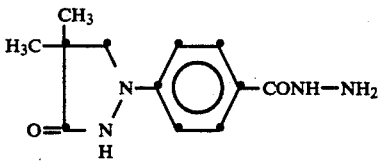

(V)

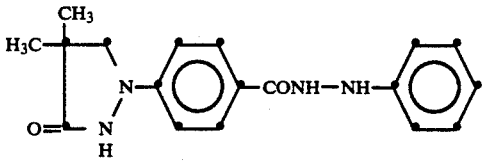

(VI)

-continued

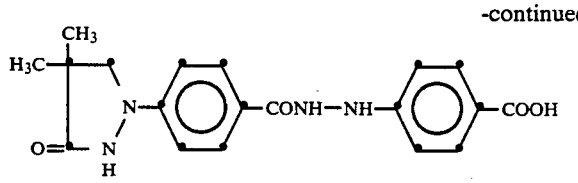
(VII)

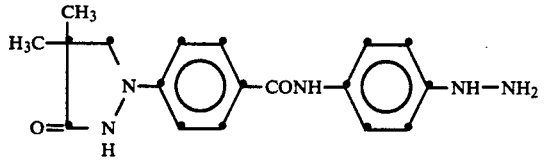
(VIII)

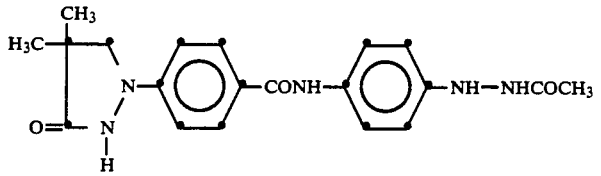
(IX)

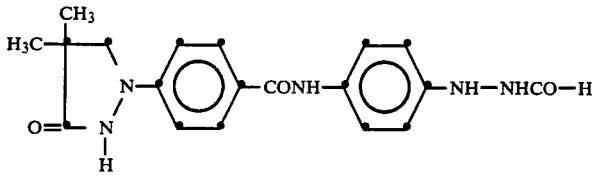
(X)

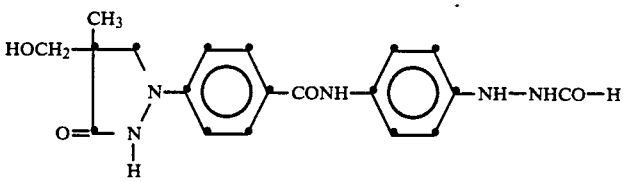
(XI)

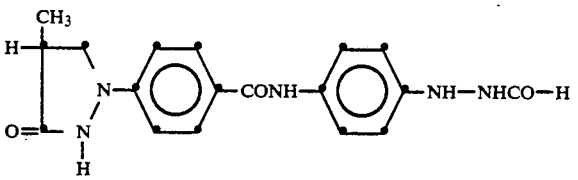
(XII)

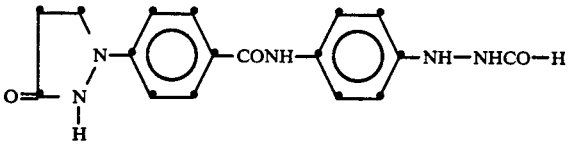
(XIII)

An interesting class of development nucleators corresponding to general formula II are the phenyl hydrazides containing water-solubilizing polyhydroxy moieties. Representatives of this class correspond to the following general formula XIV:

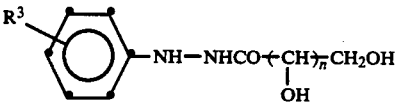
(XIV)

where:

n is a positive integer ranging from 1 to 10 and $R^3$ is hydrogen, an alkyl group, a substituted alkyl group, an aryl group, a substituted aryl group, a heterocyclic group, or a substituted heterocyclic group.

A suitable example of a heterocyclic group represented by $R^3$ in general formula XIV is a pyrazolidin-3-one-1-yl group, which may be substituted.

Suitable examples of development nucleators corresponding to general formula XIV are the compounds, in which n is 4 or 5 and $R^3$ is hydrogen.

Mixtures of at least 2 of the above-mentioned development nucleators can be used advantageously.

As mentioned before, nucleating amounts of the development nucleators are present during development of the image-wise exposed photographic material and can be incorporated for that purpose e.g. into the light-sensitive silver halide emulsion layer or into a hydrophilic colloid layer in water-permeable relationship therewith. Alternatively, they can also be added to the developer or to a separate bath.

When used in the silver halide emulsion layer the development nucleators are present in a concentration of $10^{-4}$ to $10^{-1}$ mol per mol of silver halide.

Prior to the coating of the composition that will form the photographic layer comprising at least one development nucleator, the development nucleator(s) can be dissolved in an organic solvent and added to said composition. For instance, $1.3\times10^{-3}$ mol of the development nucleator is added in the form of a 3.5% solution in N-methyl-pyrrolidone per mol of silver.

According to a preferred embodiment the development nucleator(s) are added in dispersed form to the hydrophilic colloid composition that will form said emulsion layer or said hydrophilic colloid layer. When these hydrazines are present in dispersed form in a hydrophilic colloid layer, preferably in the internal latent image-type silver halide emulsion layer, the direct-positive images obtained upon development have a very fine grain.

The development nucleator(s) can be incorporated into the hydrophilic colloid composition that will form said emulsion layer or said hydrophilic colloid layer by dissolving them first in at least one water-immiscible, oil-type solvent or oil-former, adding the resulting solution to an aqueous phase containing a hydrophilic colloid preferably gelatin and a dispersing agent, passing the mixture through a homogenizing apparatus so that a dispersion of the oily solution in an aqueous medium is formed, mixing the dispersion with a hydrophilic colloid composition e.g. a gelatin silver halide emulsion, and coating the resulting composition in the usual manner to produce a system in which particles of development nucleator(s), surrounded by an oily membrane, are distributed throughout the gel matrix. The dissolution of the development nucleator(s) in the oil-former may be facilitated by the use of an auxiliary low-boiling water-immiscible solvent, which is removed afterwards by evaporation.

The development nucleator(s) can be dispersed in hydrophilic colloid compositions with the aid of at least one known oil-former e.g. an alkyl ester of phthalic acid. The oil-formers can be used in widely varying concentrations e.g. in amounts ranging from about 0.1 to about 10 parts by weight and preferably from 0.5 to 2 parts by weight relative to the amount of the development nucleator(s) dispersed therewith.

It may be useful to combine the oil-former with at least one auxiliary solvent that is insoluble or almost insoluble in water and has a boiling point of at most 150° C., such as a lower alkyl acetate e.g. ethyl acetate.

According to a preferred embodiment of the present invention the development nucleator(s) are incorporated into the hydrophilic colloid composition that will form said silver halide emulsion layer or said hydrophilic colloid layer by mixing the development nucleator(s) in the absence of an oil-former and a solvent with an aqueous hydrophilic colloid solution, preferably an aqueous gelatin solution, passing the resulting mixture through a homogenizing apparatus, adding the dispersion obtained to said hydrophilic colloid composition that will form said emulsion layer or said hydrophilic colloid layer, and coating said hydrophilic colloid composition on a support.

The homogenizing apparatus can be any of the devices currently used for making dispersions e.g. an ultrasonic power generator, a mill such as a ball mill, a sand mill, and a colloid mill.

In the photographic light-sensitive direct-positive material according to the present invention the development nucleator(s) is(are) preferably present in the internal latent image-type silver halide emulsion layer. However, the development nucleator(s) can also be incorporated into a hydrophilic colloid layer that stands in water-permeable relationship with the internal latent image-type silver halide emulsion layer e.g. in said protective hydrophilic colloid layer having a thickness in dry state of 1 to 3 μm. The hydrophilic colloid layer can be any layer that makes part of the photographic light-sensitive direct-positive material according to the present invention. It can thus be i.a. a light-sensitive layer, an intermediate layer, a filter layer, a protective layer, an antihalation layer, an antistress layer, a subbing layer, or any other layer. In other words, any layer will do provided the development nucleator(s) is(are) not prevented from diffusing to the internal latent image-type silver halide emulsion layer.

The development nucleator(s) used according to the present invention preferably is (are) incorporated into the layer(s) in an amount that yields satisfactory maximum density values of e.g. at least 1.50 when the internal latent image-type emulsion is developed with a surface-developing solution. The amount may vary within wide limits and depends upon the nature of the silver halide emulsion, the chemical structure of the development nucleator(s), and on the developing conditions. Nevertheless, an amount of from about 0.1 to about 15 g per mol of silver halide in the internal latent image-type silver halide emulsion is generally effective, more preferably an amount of from about 0.6 to about 9 g per mol of silver halide. When the development nucleator(s) is(are) incorporated into a hydrophilic colloid layer that stands in water-permeable relationship with the internal latent image-type silver halide emulsion layer, it is adequate to incorporate the development nucleator(s) in the above amounts while taking into account the amount of silver contained in the associated internal latent image-type emulsion layer.

An internal latent image-type silver halide emulsion is an emulsion, the maximum density of which obtained when developing it with an "internal type" developing solution exceeds the maximum density that is achievable when developing it with a "surface-type" developing solution. The internal latent image-type emulsions that are suited for use in accordance with the present invention yield a maximum density that, when these emulsions have been coated on a transparent support and are exposed to light for a fixed time of from 1/100 to 1 s and then developed for 3 min at 20° C. with the internal-type Developing Solution A as described hereinafter, is higher by at least 5 times than the maximum density obtained when the silver halide emulsion exposed as described above is developed for 4 min at 20° C. with the surface-type Developing Solution B as described hereinafter.

| | |
|---|---|
| Internal-type Developing Solution A | |
| hydroquinone | 15 g |
| monomethyl-p-aminophenol sulphate | 15 g |
| anhydrous sodium sulphite | 50 g |
| potassium bromide | 10 g |
| sodium hydroxide | 25 g |
| crystalline sodium thiosulphate | 20 g |
| Water to make | 1 l |
| Surface-type Developing Solution B | |
| p-hydroxyphenylglycine | 10 g |

-continued

| | |
|---|---|
| crystalline sodium carbonate | 100 g |
| water to make | 1 l |

Internal latent image-type silver halide emulsions that can be used in accordance with the present invention have been described in e.g. U.S. Pat. Nos. 2,592,250, 3,206,313, 3,271,157, 3,447,927, 3,511,662, 3,737,313, 3,761,276, GB-A 1,027,146, and JA Patent Publication No. 34,213/77. However, the silver halide emulsions used in the present invention are not limited to the silver halide emulsions described in these documents.

The internal latent image-type silver halide emulsions that are suited for use according to the present invention are emulsions that have not been prefogged externally or only very slightly so and that have not been ripened chemically or only slightly so.

The photographic emulsions can be prepared according to different methods as described e.g. by P. Glafkides in "Chimie et Physique Photographique", Paul Montel, Paris (1967), by G. F. Duffin in "Photographic Emulsion Chemistry", The Focal Press, London (1966), and by V. L. Zelikman et al in "Making and Coating Photographic Emulsion", The Focal Press, London (1966).

The photographic silver halide emulsions used according to the present invention can be prepared by mixing the halide and silver solutions in partially or fully controlled conditions of temperature, concentrations, sequence of addition, and rates of addition. The silver halide can be precipitated according to the single-jet method, the double-jet method, or the conversion method. The conversion method has proved to be particularly suitable. According to this method a more soluble silver halide is converted into a less soluble silver halide. For instance a silver chloride emulsion is converted in the presence of water-soluble bromide and possibly iodide, the amounts of which are selected with regard to the finally required composition, into a silver chlorobromoiodide or a silver bromoiodide emulsion. This conversion is preferably carried out very slowly in several consecutive steps i.e. by converting a part of the more soluble silver halide at a time. Another technique by which emulsions with an increased internal latent image sensitivity can be prepared has been described in GB-A 1,011,062.

The silver halide particles of the photographic emulsions used according to the present invention may have a regular crystalline form such as a cubic or octahedral form or they may have a transition form. They may also have an irregular crystalline form such as a spherical form or a tabular form, or may otherwise have a composite crystal form comprising a mixture of said regular and irregular crystalline forms.

The silver halide grains may have a multilayered grain structure. According to a simple embodiment the grains may comprise a core and a shell, which may have different halide compositions and/or may have undergone different modifications such as the addition of dopes. Besides having a differently composed core and shell the silver halide grains may also comprise different phases inbetween.

Two or more types of silver halide emulsions that have been prepared differently can be mixed for forming a photographic emulsion for use in the method of the present invention.

The average size of the silver halide grains may range from 0.1 to 2.0 μm, preferably from 0.3 to 0.8 μm.

The size distribution of the silver halide particles of the photographic emulsions used according to the present invention can be homodisperse or heterodisperse. A homodisperse size distribution is obtained when 95% of the grains have a size that does not deviate more than 30% from the average grain size.

In addition to silver halide the emulsions may also comprise organic silver salts such as e.g. silver benzotriazolate and silver behenate.

The silver halide crystals can be doped with $Rh^{3+}$, $Ir^{4+}$, $Cd^{2+}$, $Zn^{2+}$, $Pb^{2+}$.

The emulsion can be left unwashed or it can be desalted in the usual ways e.g. by dialysis, by flocculation and re-dispersing, or by ultrafiltration.

Commonly, the light-sensitive silver halide emulsions used according to the present invention have not been sensitized chemically. However, they may have been chemically sensitized or prefogged to a minor degree. Chemical sensitization can be performed as described i.a. in the above-mentioned "Chimie et Physique Photographique" by P. Glafkides, in the above-mentioned "Photographic Emulsion Chemistry" by G. F. Duffin, in the above-mentioned "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968).

The intrinsic sensitivity range of the photographic silver halide emulsions used according to the present invention normally is limited to wavelengths shorter than about 510 nm. In consequence thereof they can be handled in safe-light conditions prior to the image-wise exposure.

It is possible, however, to spectrally sensitize the photographic silver halide emulsion to a spectral range above 510 nm and up to the infrared region, e.g. for exposure by means of infrared-emitting lasers or diodes.

Density-increasing compounds may be incorporated into the photographic light-sensitive direct-positive silver halide material, preferably into an internal latent image-type silver halide emulsion layer thereof, although they may be incorporated also into a hydrophilic colloid layer that stands in water-permeable relationship with the internal latent image-type silver halide emulsion layer e.g. in said protective hydrophilic colloid layer comprising at least 1 g of hydrophilic colloid per m2.

Suitable density-increasing compounds are formic acid, oxalic acid, glyoxylic acid, or salts of these, and polyethylene glycols. When incorporated into the photographic element the density-increasing compound is present in amounts of from 4 to 600 mg/m2, preferably from 40 to 300 mg/m2. When the density-increasing compound is incorporated into a hydrophilic colloid layer it is present therein in the form of a salt e.g. sodium or potassium formiate or oxalate.

It is also possible to incorporate the density-increasing compound into a hydrophilic colloid layer that does not stand in direct water-permeable relationship with the internal latent image-type silver halide emulsion layer e.g. because an impermeable support constitutes a barrier between said emulsion layer and said hydrophilic colloid layer. In that case the density-increasing compound can during treatment of the exposed material with a developing solution or a prebath diffuse via said developing solution or said prebath towards the silver halide emulsion layer and have its effect there. Such layers are e.g. layers that have been coated on the rear side of the support and which may serve different purposes. Examples of such layers are e.g. a back layer, an anti-curling layer, and an antistatic layer.

The density-increasing compound may also be added to the developing solution in amounts of from 0.2 to 30 g/l, preferably from 1 to 10 g/l. The density-increasing compound may also be added to another processing solution e.g. a prebath. When the density-increasing compound is added to the developing solution or to a prebath it is present therein in acid form or in the form of a salt.

A preferred density-increasing compound is oxalic acid, because it has the highest density-increasing effect and can thus be used in lower concentrations.

For processing the photographic material of the present invention any of the known methods can be employed. Specifically, the processing method used according to the present invention basically includes a development step and a fixing step. A stopping step and a rinsing step can be included as well, if desired. The processing temperature is usually selected within the range of from 18° C. to 50° C. However, temperatures lower than 18° C. and temperatures higher than 50° C. can be employed, if desired. The processing time may vary within broad ranges provided the mechanical strength of the materials to be processed is not adversely influenced and no decomposition takes place.

The hydroquinone-type developing solution used for developing an exposed photographic material in accordance with the present invention may comprise at least one alkanolamine, which may be chosen from primary, secondary, and tertiary alkanolamines. Suitable alkanolamines are i.a. N,N,N-triethanolamine, 2-amino-2-hydroxymethyl-propan-1,3-diol, N-methyl-5-diethanolamine, N-ethyl-diethanolamine, diisopropanolamine, N,N-diethanolamine, 3,3'-amino-dipropanol, 2-amino-2-methyl-propan-1,3-diol, N-propyldiethanolamine, N-butyl-diethanolamine, N,N-dimethyl-ethanolamine, N,N-diethyl-ethanolamine, N,N-diethyl-isopropanolamine, 1-amino-propan-2-ol, N-ethanolamine, N-methyl-ethanolamine, N-ethyl-ethanolamine, N-ethylpropanolamine, 3-amino-propanol, 3-dimethylamino-propanol, 4-amino-butanol, and 5-amino-pentan-1-ol.

The alkanolamine or a mixture of alkanolamines may be present in the developing solution in amounts of from 1 to 100 g/l, preferably 10 to 60 g/l.

In the developing solution used in the method of the present invention, a hydroquinone alone or a combination of a hydroquinone with a secondary developing agent of the class of 1-phenyl-3-pyrazolidinone compounds and p-N-methyl-aminophenol can be used as developing agent. Specific examples of hydroquinones include hydroquinone, methylhydroquinone, t-butylhydroquinone, chloro-hydroquinone, and bromohydroquinone.

Particularly useful 1-phenyl-3-pyrazolidinone developing agents that can be used in combination with a hydroquinone are 1-phenyl-3-pyrazolidinone, 1-phenyl-4-methyl-3-pyrazolidinone, 1-phenyl-4-ethyl-5-methyl-3pyrazolidinone, and 1-phenyl-4,4-dimethyl-3-pyrazolidinone.

N-methyl-p-aminophenol and 2,4-diaminophenol can be used in combination with a hydroquinone as a developing agent.

When the secondary developing agent used in the processing method of the present invention is one of the class of the 1-phenyl-3-pyrazolidinone compounds it is preferably present in an amount of 2 to 20 g per liter. When the secondary developing agent is p-N-methyl-aminophenol it is preferably present in an amount of 10 to 40 g per liter.

The developing solution comprises a preservative such as a sulphite e.g. sodium sulphite in an amount ranging from 45 g to 160 g per liter.

The developing solution comprises alkali-providing substances such as hydroxides of sodium and potassium, alkali metal salts of phosphoric acid and/or silicic acid e.g. trisodium phosphate, orthosilicates, metasilicates, hydrodisilicates of sodium or potassium, and sodium carbonate. The alkali-providing substances can be substituted in part or wholly by alkanolamines.

The developing solution may comprise a buffering agent such as e.g. sodium or potassium carbonate, trisodium phosphate, and sodium metaborate.

For the purpose of decreasing the formation of fog (Dmin) the developing solution may further contain an inorganic anti-fogging agent such as a bromide e.g. potassium bromide and/or an organic anti-fogging agent such as a benzimidazole e.g. 5-nitro-benzimidazole, a benzotriazole like benzotriazole itself and 5-methyl-benzotriazole.

The developing solution may contain other ingredients such as i.a. toning agents, development accelerators, oxidation preservatives, surface-active agents, defoaming agents, water-softeners, anti-sludge agents, hardeners including latent hardeners, and viscosity-adjusting agents.

Regeneration of the developing solution according to known methods is, of course, possible.

The development may be stopped—though this is often not necessary—with an aqueous solution having a low pH. An aqueous solution having a pH not higher than 3.5 comprising e.g. acetic acid and sulphuric acid, and containing a buffering agent is preferred.

Buffered stop bath compositions comprising a mixture of sodium dihydrogen orthophosphate and disodium hydrogen orthophosphate are preferred.

Conventional fixing solutions may be used. Examples of useful fixing agents include organic sulphur compounds known as fixing agents, as well as a thiosulphate, a thiocyanate, etc. The fixing solution may contain a water-soluble aluminum salt as a hardening agent.

The stopping solution may be an aqueous solution having a low pH. An aqueous solution having a pH not higher than 3.5 comprising e.g. acetic acid and sulphuric acid, and containing a buffering agent is preferred.

Suitable additives for improving the dimensional stability of the photographic material can also be incorporated therein together with the hydrophilic colloid binder of the silver halide emulsion. Suitable examples of this type of compounds include i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth)acrylates, sulphoalkyl (meth)acrylates, and styrene sulphonic acids.

Various compounds can be added to the photographic emulsion to prevent the reduction in sensitivity or fog formation during preparation, storage, or processing of the photographic material. A great many compounds are known for these purposes, and they include homopolar or salt-like compounds of mercury with aromatic or heterocyclic rings such as mercaptotriazoles, simple mercury salts, sulphonium mercury double salts and other mercury compounds. Other stabilizers are azaindenes, preferably tetra- or penta-azaindenes, especially those substituted with hydroxy or amino groups e.g. 4-hydroxy-6-methyl- 1,3,3*a*,7-tetraazaindene. Compounds of this kind have been described by Birr in Z. Wiss. Photogr. Photophys. Photochem. 47, 2–27 (1952). Other suitable stabilizers are i.a. heterocyclic mercapto compounds e.g. 1-phenyl-5-mercaptotetrazole, 3-methyl-benzothiazole, quaternary benzothiazole derivatives, benzotriazole. Specific examples of stabilizers have been mentioned by K. Mees in The Theory of the Photographic Process, 3rd ed. 1966 by reference to the papers that first reported such compounds, and in addition, have been described in i.a. U.S. Pat. Nos. 1,758,576, 2,110,178, 2,131,038, 2,173,628, 2,304,962, 2,324,123, 2,394,198, 2,444,605, 2,444,606, 2,444,607, 2,444,608, 2,476,536, 2,566,245, 2,694,716, 2,697,040, 2,697,099, 2,708,162, 2,728,663, 2,728,664, 2,728,665, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, and 3,622,339, GB-A 893,428, 403,789, 1,173,609 and 1,200,188.

The silver halide emulsions may comprise other ingredients e.g. development accelerators, wetting agents, and hardeners. The hydrophilic colloid binder of the silver halide emulsion layer and/or of other hydrophilic colloid layers can, especially when the binder used is gelatin, be hardened with appropriate hardening agents such as those of the epoxide type, those of the ethylenimine type, those of the vinylsulfone type e.g. 1,3-vinylsulphonyl 2-propanol chromium salts e.g. chromium acetate and chromium alum, aldehydes e.g. formaldehyde glyoxal, and glutaraldehyde, N-methylol compounds e.g. dimethylolurea and methyloldimethylhydantoin. dioxan derivatives e.g. 2,3-dihydroxydioxan, active vinyl compounds e.g. 1,3,5-triacryloylhexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts and the phosphorus compounds described in EP Application No. 89201865.6, which corresponds to the U.S. Ser. No. 7/551,030.

The photographic light sensitive direct-positive material of the present invention may contain a water-soluble dye in a hydrophilic colloid layer as a filter dye or for other various purposes such as for the prevention of irradiation or anti-halation. Such dyes include oxonol dyes, hemioxonol dyes, styryl dyes, merocyanine dyes cyanine dyes and azo dyes. Of these, oxonol dyes, hemioxonol dyes, and merocyanine dyes are useful.

When a hydrophilic colloid layer of the photographic light-sensitive direct-positive material of the present invention contains a dye or an UV-absorbing agent, these compounds may be mordanted by means of a cationic polymer e.g. polymers described in GB-A 1,468,460 and 685,475, U.S. Pat. Nos. 2,675,316, 2,839,401, 2,882,156, 3,048,487, 3,184,309, 3,445,231, and 3,986,875, DE-A 1,914,362.

The photographic light-sensitive direct-positive material of the present invention may comprise various kinds of surface-active agents or plasticizers in the photographic emulsion layer or in at least one other hydrophilic colloid layer. Suitable surface-active agents or plasticizers include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkyl amines or alkyl amides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents or plasticizers can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast and development acceleration.

Development acceleration can be accomplished with the aid of various compounds, preferably polyalkylene derivatives having a molecular weight of at least 400 such as those described in e.g. U.S. Pat. Nos. 3,038,805, 4,038,075, and 4,292,400.

The photographic light-sensitive direct-positive material of the present invention may further comprise various other additives such as e.g. UV-absorbers, matting agents or spacing agents, and lubricants.

Suitable UV-absorbers are i.a. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

Suitable spacing agents are e.g. finely divided silica particles and polymer beads as described U.S. Pat. No. 4,614,708.

In general, the average particle size of spacing agents is comprised between 0.2 and 10 μm. Spacing agents can be soluble or insoluble in alkali. Alkali-insoluble spacing agents usually remain permanently in the photographic material, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

A matting agent and/or a lubricant may be added to an emulsion layer and/or the protective hydrophilic colloid layer of the photographic light-sensitive direct-positive material of the present invention. Suitable matting agents are e.g. water-dispersible vinyl polymers such as poly(methyl methacrylate) having an appropriate particle size of from 0.2 to 6 μm and inorganic compounds e.g. silver halide and strontium barium sulphate. The lubricant is used to improve the slidability of the photographic material. Suitable examples of lubricants are e.g. liquid paraffin, waxes such as esters of higher fatty acids, polyfluorinated hydrocarbons or derivatives thereof, silicones such as polyalkylpolysiloxanes, polyarylpolysiloxanes, polyalkylarylpolysiloxanes and alkyleneoxide addition derivatives thereof.

The protective hydrophilic colloid layer of the photographic light-sensitive direct-positive material of the present invention preferably is a gelatin layer that also comprises silica as spacing agent and one of the above-mentioned plasticizers.

A variety of photographic supports can be employed for the photographic light-sensitive direct-positive material of the present invention. The silver halide emulsion can be coated onto one side or both sides of the support. For use in COM-film the support should be highly antistatic and should therefore be highly electroconductive. Suitable supports are e.g. cellulose acetate films such as cellulose triacetate film and cellulose diacetate film, cellulose nitrate films, polyethylene terephthalate films, and polystyrene films.

In the first step for making a direct-positive image according to the method of the present invention the photographic light-sensitive direct-positive material is exposed image-wise. This exposure is a high-intensity exposure to light in the wavelength range of from about 440 to about 480 nm for short times as commonly used in COM-recorders viz. $10^{-5}$ to $10^{-8}$ s.

In a second step for making a direct-positive image the image-wise exposed silver halide material is soaked with, e.g. immersed in, a developing solution. For instance, the image-wise exposed silver halide material is conducted through a tray containing a developing solution.

The developing agents may be incorporated partially or completely into the photographic light-sensitive silver halide material. They may be incorporated during the preparation stage of the material or at a later stage by means of a processing liquid with which the photographic material is wet prior to the development of the direct-positive image. In this way the surface developer can be reduced to a mere alkaline liquid that is substantially free from developing agents. Such an alkaline aqueous liquid, often called "activator" offers the advantage of having a longer activity i.e. of being less rapidly exhausted. The preliminary processing liquid may contain at least a part of the development nucleator and may also contain other ingredients that otherwise would have been incorporated into the developing solution. Wetting of the photographic material by means of a processing liquid comprising development nucleator and/or density-increasing compound may be performed according to any conventional method such as by soaking or by moistening one single side of the material e.g. by means of a lick roller, by spreading a paste e.g. contained in a pod, or by spraying.

According to an alternative second step for making a direct-positive image the image-wise exposed silver halide material is given an overall flash with a high intensity light to fog said image-wise exposed silver halide material and is then developed in a surface developer.

The photographic light-sensitive silver halide material used in the method of the present invention may serve different purposes. Application fields, in which direct-positive images can be made in accordance with the present invention, are i.a. graphic arts recording processes, silver salt diffusion transfer reversal processes, microfilm recording processes, duplicating processes for cinematographic black-and-white negatives, laser recording processes, X-ray recording processes, cathode-ray recording processes, fototype-setting processes, etc.

The present invention will be explained in greater detail by reference to the following examples. The present invention should, however, not be construed as being limited thereto.

EXAMPLE 1

An internal latent image-type direct-positive gelatin silver halide emulsion was prepared by conversion of a silver chloride emulsion in the presence of water-soluble bromide and iodide to form grains having a core of silver chloride (4 mol %) and a shell of silver bromoiodide (95/1 mol %). The average grain diameter was 0.4 μm.

A dispersion of the development nucleator 1-formyl-2-phenyl-hydrazine was made by passing a mixture of 300 g of a 20% aqueous solution of gelatin and 60 g of the development nucleator for 120 min through a sand mill.

The dispersion was added to the silver halide emulsion in a concentration of 200 mg per 5 g of silver halide.

The emulsion obtained was divided in 2 batches.

The first batch was divided into 4 samples A, C, D, and E.

The weight ratio of gelatin to silver halide (expressed as silver nitrate) samples A, C, D, and E was adjusted to 0.6 corresponding to 3.3 g of gelatin per 5.5 g of silver nitrate.

For comparison purposes no iodide-providing compound was added to sample A.

The samples C, D, and E, however, were admixed with different amounts of a 5% aqueous potassium iodide solution in such a way that the concentrations of iodide (expressed in parts of $I^-$ per million of $Ag^+$) in the samples were as specified in Table 1 hereinafter.

Each of the samples A, C, D, and E was coated on a cellulose triacetate support at a ratio of 6.5 g of silver halide per m2 and dried.

A protective gelatin layer was coated on the dry emulsion layer of samples A, C, D, and E at a ratio of 2.4 g of gelatin per m2, which corresponds to a thickness of approximately 2.4 μm.

The second batch was also divided into 4 samples B, F, G, and H.

The weight ratio of gelatin to silver halide of Batches B, F, G, and H was adjusted to 1.0 (5.5 g of gelatin per 5.5 g of silver nitrate).

For comparison purposes no iodide-providing compound was added to sample B.

The samples F, G, and H were admixed, however, with different amounts of a aqueous potassium iodide solution in such a way that the concentrations of iodide (expressed in parts of $I^+$ per million of $Ag^+$) in the samples were as specified in Table 1 hereinafter.

Each of the samples B, F, G, and H was coated on a cellulose triacetate support as described for the samples A, C, D, and E and dried. A protective gelatin layer was coated on the dry emulsion layer of samples B, F, G, and H at a ratio of 3.2 g of gelatin per m2, which corresponds to a thickness of approximately 3.2 μm.

Mechanical pressure was then put on each of the dry samples A to H by means of a device in which a steel ball was drawn over the protective layer of each sample, the ball having a diameter of 3 mm. The ball was charged with a weight of 1100 g.

Each sample was then exposed for $10^{-5}$ s to white light emitted by a U460 flashlight sold by EG&G ING, 45 William street, Wellesley, Mass. 02181, USA and then developed with a hydroquinone-type developing solution at a temperature of 35° C., said developing solution comprising the following ingredients:

| | |
|---|---|
| demineralized water | 700 ml |
| hydroquinone | 24 g |
| p-N-methyl-aminophenol | 30 g |
| N-dimethyl-propanolamine | 40 ml |
| sodium sulphite | 50 g |
| sodium hydroxide | 18 g |
| sodium carbonate | 40 g |
| potassium bromide | 3 g |
| demineralized water to make | 1 l |

The developed direct-positive image obtained was then checked visually for the presence of unwanted white streaks or markings at the places where the mechanical pressure had been exerted and possibly caused sensitization. This visual evaluation is reflected in the following Table 1. The values listed therein are rated from 100 down to 10. The lower the values, the better the quality. 100 stands for bad, meaning that so many streaks or markings were present that a lot of image details were disturbed, 75 stands for unsatisfactory, meaning that some image details were disturbed, 50 for good, meaning that only minor defects were seen, which did not actually impair the interpretability of the image obtained. The lower values stand for an even better quality, 10 meaning that no streaks or markings were present at all.

TABLE 1

| Sample | Gelatin/Ag ratio | Protective gelatin layer (in g/m2) | ppm of $I^-$ | Evaluation |
|---|---|---|---|---|
| A | 0.6 | 2.4 | — | 100 |
| B | 1.0 | 3.2 | — | 75 |
| C | 0.6 | 2.4 | 580 | 75 |
| D | 0.6 | 2.4 | 1160 | 65 |
| E | 0.6 | 2.4 | 1740 | 50 |
| F | 1.0 | 3.2 | 1160 | 50 |
| G | 1.0 | 3.2 | 2900 | 30 |
| H | 1.0 | 3.2 | 5800 | 10 |

The results listed in the table show that a reduced tendency of getting sensitized under the influence of mechanical pressure applied prior to the development can be obtained by increasing the gelatin to silver ratio and the thickness of the protective hydrophilic colloid layer. However, in consequence of the higher layer thickness this leads to a reduction in image sharpness.

The table also shows that the presence of iodide further reduces the tendency of getting sensitized under the influence of mechanical pressure applied prior to the development and that optimum results are obtained by using said threefold combination according to the present invention.

I claim:

1. Photographic light-sensitive silver halide material for forming direct-positive images, said material comprising a support, at least one light-sensitive emulsion layer comprising unfogged internal latent image-type silver halide grains dispersed in a hydrophilic colloid binder and comprising a development nucleator, and at least one protective hydrophilic colloid layer, wherein said light-sensitive emulsion comprises at least one compound that during development of said material in a surface developer provides iodide ions, the weight ratio of the hydrophilic colloid binder of said emulsion layer to silver halide expressed as silver nitrate ranges from 0.4:1 to 3:1, and said protective hydrophilic colloid layer has a thickness in dry state of 1 to 3 μm.

2. A photographic light-sensitive silver halide material according to claim 1, wherein the iodide ion-providing compound is present in said at least one light-sensitive silver halide emulsion layer.

3. A photographic light-sensitive silver halide material according to claim 2, wherein the iodide ion-providing compound is present in a concentration ranging from 0.01 to 1 g per mol of silver halide.

4. A photographic light-sensitive silver halide material according to claim 1, wherein the iodide ion-providing compound is potassium iodide.

5. A photographic light-sensitive silver halide material according to claim 1, wherein the weight ratio of the hydrophilic colloid binder of said emulsion layer to silver halide expressed as silver nitrate ranges from 0.5:1 to 2:1.

6. A photographic light-sensitive silver halide material according to claim 1, wherein the hydrophilic colloid of said protective layer is gelatin.

7. Method for making developed direct-positive images having no unwanted white streaks or markings, said method comprising:

image-wise exposing a photographic light-sensitive silver halide material comprising a support, at least one light-sensitive emulsion layer comprising unfogged internal latent image-type silver halide grains dispersed in a hydrophilic colloid binder, and at least one protective hydrophilic colloid layer, and either (a) developing the image-wise exposed material in a surface developer in the presence of at least one development nucleator or (b) overall light-flashing to fog said image-wise exposed material and subsequently developing it in a surface developer, wherein (a) said light-sensitive silver halide material comprises at least one compound that during development of said material in said surface developer provides iodide ions, (b) the weight ratio of the hydrophilic colloid binder of said emulsion layer to silver halide expressed as silver nitrate ranges from 0.4:1 to 3:1, and (c) said protective hydrophilic colloid layer has a thickness in dry state of 1 to 3 μm.

8. A method according to claim 7, wherein said at least one development nucleator is incorporated into said silver halide emulsion layer or into a hydrophilic colloid layer in water-permeable relationship therewith.

9. A method according to claim 7, wherein said development nucleator is 1-formyl-2-phenyl-hydrazine.

* * * * *